US008011436B2

(12) United States Patent
Christie et al.

(10) Patent No.: US 8,011,436 B2
(45) Date of Patent: Sep. 6, 2011

(54) THROUGH RISER INSTALLATION OF TREE BLOCK

(75) Inventors: David S. Christie, Aberdeen (GB); Robert Voss, Peterculter (GB); Peter Breese, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 1044 days.

(21) Appl. No.: 11/696,814

(22) Filed: Apr. 5, 2007

(65) Prior Publication Data

US 2008/0245529 A1 Oct. 9, 2008

(51) Int. Cl.
*E21B 29/12* (2006.01)
*E21B 7/12* (2006.01)

(52) U.S. Cl. ..... 166/359; 166/338; 166/382; 166/378; 166/386; 166/85.1

(58) Field of Classification Search ..... 166/357, 166/359, 338, 340, 345, 378, 381, 377, 382, 166/386, 85.1
See application file for complete search history.

(56) References Cited

U.S. PATENT DOCUMENTS

| | | | | |
|---|---|---|---|---|
| 4,077,472 | A * | 3/1978 | Gano | 166/382 |
| 4,607,701 | A * | 8/1986 | Gundersen | 166/368 |
| 4,754,813 | A * | 7/1988 | Jennings et al. | 166/344 |
| 4,958,686 | A * | 9/1990 | Putch | 166/348 |
| 5,280,766 | A * | 1/1994 | Mohn | 166/368 |
| 5,535,826 | A * | 7/1996 | Brown et al. | 166/363 |
| 5,544,707 | A * | 8/1996 | Hopper et al. | 166/382 |
| 5,873,415 | A * | 2/1999 | Edwards | 166/344 |
| 6,015,013 | A * | 1/2000 | Edwards et al. | 166/360 |
| 6,039,120 | A * | 3/2000 | Wilkins et al. | 166/368 |
| 6,053,252 | A * | 4/2000 | Edwards | 166/348 |
| 6,076,605 | A * | 6/2000 | Lilley et al. | 166/368 |
| 6,109,352 | A * | 8/2000 | Edwards et al. | 166/336 |
| 6,170,578 | B1 * | 1/2001 | Edwards et al. | 166/339 |
| 6,227,300 | B1 * | 5/2001 | Cunningham et al. | 166/339 |
| 6,343,654 | B1 * | 2/2002 | Brammer | 166/338 |
| 6,460,621 | B2 | 10/2002 | Fenton et al. | |
| 6,698,520 | B2 | 3/2004 | Fenton et al. | |
| 6,715,554 | B1 * | 4/2004 | Cunningham et al. | 166/348 |
| 6,729,392 | B2 * | 5/2004 | DeBerry et al. | 166/75.14 |
| 6,823,941 | B2 * | 11/2004 | Donald | 166/368 |
| 6,966,383 | B2 * | 11/2005 | Milberger et al. | 166/368 |

(Continued)

FOREIGN PATENT DOCUMENTS

GB 2429722 A 3/2007

(Continued)

OTHER PUBLICATIONS

U.S. Appl. No. 11/007,947, filed Dec. 9, 2004, Crozier.

*Primary Examiner* — Thomas A Beach
(74) *Attorney, Agent, or Firm* — Bracewell & Giuliani LLP

(57) ABSTRACT

A subsea well assembly has a tubing hanger that lands and seals in a wellhead housing. A tree block is lowered through the drilling riser into engagement with the tubing hanger. The tree block has a lower portion that inserts and latches into the bore of the wellhead housing. The drilling riser is disconnected, and a module is lowered onto the tree block, the module having a choke and controls for controlling the well. The master valve for production is the downhole safety valve in the tubing. The wing production valve is a ball valve located in the flow passage of the tree block.

14 Claims, 3 Drawing Sheets

U.S. PATENT DOCUMENTS

| | | | | |
|---|---|---|---|---|
| 6,978,839 | B2 | 12/2005 | Fenton et al. | |
| 7,114,571 | B2 * | 10/2006 | Gatherar et al. | 166/367 |
| 7,240,735 | B2 * | 7/2007 | Crozier | 166/344 |
| 7,647,974 | B2 * | 1/2010 | Fenton | 166/368 |
| 2004/0074635 | A1 * | 4/2004 | Collie et al. | 166/85.1 |
| 2004/0262010 | A1 * | 12/2004 | Milberger | 166/368 |
| 2009/0294131 | A1 * | 12/2009 | Lewis | 166/368 |

FOREIGN PATENT DOCUMENTS

| | | | |
|---|---|---|---|
| WO | 2005/098198 | A1 | 10/2005 |

* cited by examiner

THROUGH RISER INSTALLATION OF TREE BLOCK

FIELD OF THE INVENTION

This invention relates in general to subsea wellhead assemblies, and in particular to a tree block that is installable through the drilling riser.

DESCRIPTION OF THE PRIOR ART

A subsea well is typically drilled by drilling the well to a first depth and installing an outer wellhead housing, which is secured to the upper end of conductor pipe. The operator drills to a second depth and installs an inner or high pressure wellhead housing, which is secured to an intermediate string of casing. A drilling riser is attached to the inner wellhead housing, the drilling riser having a blowout preventer that may be at the drilling vessel or more typically at the lower end of the riser. The operator drills the well deeper and installs an inner string of casing, which is supported by a casing hanger that lands and seals in the bore of the inner wellhead housing. Some wells may have more than one string of inner casing by the time the well reaches total depth.

The well may be completed in different manners from that point onward. In one type, the operator disconnects the drilling riser and lowers a string of tubing on a dual passage completion riser. The completion riser has one passage for communicating with the interior of the tubing and another for communicating with the annulus surrounding the tubing. The tubing hanger lands in the inner wellhead housing, and the dual passages in the completion riser enable the operator circulate fluid through the tubing. The operator may perforate through the tubing at this point and then set wire line plugs in the tubing annulus port and in the production passage in the tubing hanger.

The operator then lowers a production or Christmas tree onto the wellhead housing. The tree has a production passage that stabs into the production passage of the tubing hanger and an annulus passage that stabs into the annulus passage. The tree also has a number of valves, including a master valve in the production passage and a wing valve leading from a production outlet. The tree has a control system that hydraulically controls the various valves. The operator removes the wire line plugs previously installed.

In another type of tree, known as a horizontal or spool tree, after the well has been cased, the operator disconnects the riser from the inner wellhead housing and lands the tree. The operator connects the drilling riser to the tree and runs the tubing and tubing hanger. The tubing hanger lands in the tree and has a laterally extending flow passage that communicates with the production outlet of the tree. A tubing annulus bypass passage extends through the side wall of the tree around the tubing hanger and back into the tree bore above the tubing hanger to enable circulation through the tubing. The operator perforates by lowering the perforating equipment through the tree and the tubing. The horizontal tree also has a control system for controlling the master and wing valves as well as other valves and operations.

Both the conventional tree described above and the horizontal tree have downhole safety valves connected in the tubing. The downhole safety valve is located a relatively short distance below the tubing hanger, such as 100 to 500 hundred feet, and serves to shut off flow through the tubing in the event of damage to the tree. The downhole safety valve will close unless hydraulic fluid pressure is maintained. Typically these valves are ball valves, and the control system for each tree will maintain a supply of hydraulic fluid pressure to these valves as well as the other valves on the tree.

Both the vertical and the horizontal types of trees work well, but are large, complex, expensive and, perhaps in some cases, overly redundant in the number of valves that they contain.

SUMMARY OF THE INVENTION

In this invention, the subsea wellhead assembly, like the prior type, has a subsea wellhead housing and at least one string of casing supported by a casing hanger in the wellhead housing. A tree block with a flow passage containing a valve is utilized. Unlike the prior art, the tree block has a maximum outer diameter that is less than the inner diameter of the riser so that it can be run through the riser. The tree block interfaces with the tubing hanger, which lands in the inner wellhead housing. The tubing hanger has a flow passage and either the tubing hanger or the tubing will have a valve, such as a downhole safety valve.

The tubing hanger and the tree block each latch and seal independently to the bore of the wellhead housing. After installation of the tree block, the casing is perforated and the drilling riser disconnected from the wellhead housing. The operator then lowers a flow line connection module to the adapter. The module has a flow passage that registers with the flow passage in the adapter. The module has a coupling that connects the module to a flow line. The lower valve, which is the one in the tubing or the tubing hanger, serves as the master valve for the well. The upper valve, which is the one in the tree block, serves as the wing valve.

DETAILED DESCRIPTION OF THE INVENTION

Figure 1:
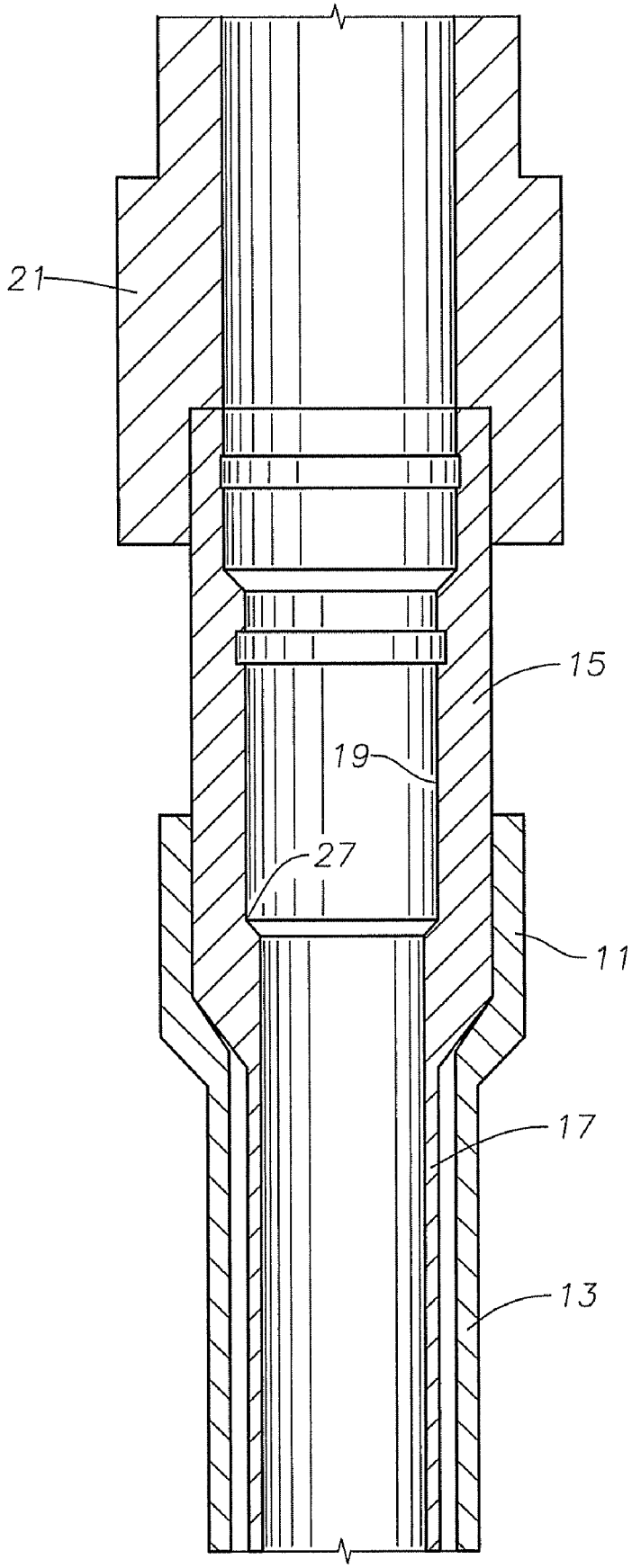
FIG. 1 is a schematic, cross-sectional view of a subsea wellhead housing connected to a drilling riser, to enable an operator to perform a step of the invention.

Referring to FIG. 1, outer wellhead housing 11 is conventional and located at on the sea floor at the upper end of a string of conductor pipe or outer casing 13 that extends to a first depth in the well. An inner wellhead housing 15, also conventional, is shown landed in outer wellhead housing 11. Inner wellhead housing 15 is secured to an intermediate string of casing 17 that extends to a second depth in the well. Inner wellhead housing 15 has a bore 19 extending through it. A drilling riser 21, which also includes a blowout preventer, is attached to the upper end of inner wellhead housing 15. Drilling riser 21 has a passage through it that is at least equal to the maximum inner diameter of bore 19. As is conventional, the connection of drilling riser 21 with inner wellhead housing 15 includes a seal that forms a pressure-containing interior within drilling riser 21. Drilling riser 21 extends to a drilling platform on the surface.

Figure 2:
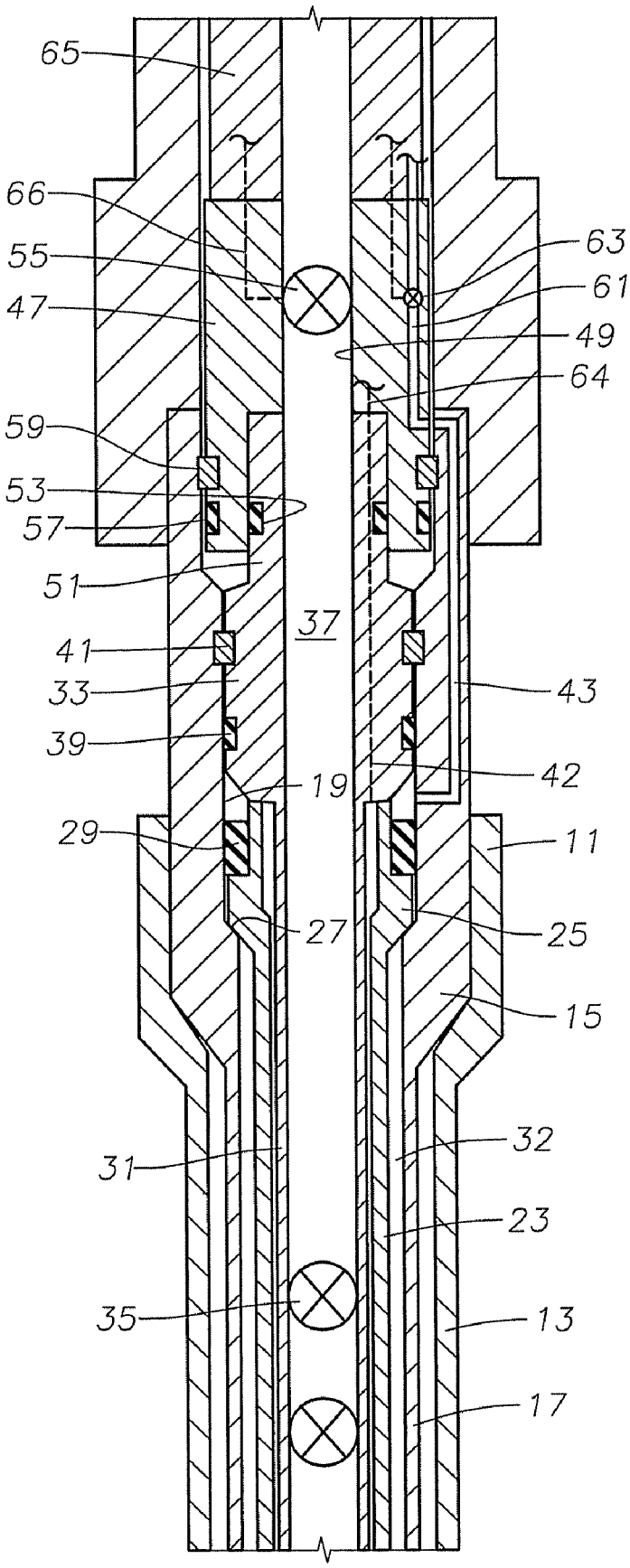
FIG. 2 is a schematic, cross-sectional view of the assembly as in FIG. 1, and also showing a tree block being installed through the drilling riser.
Figure 3:
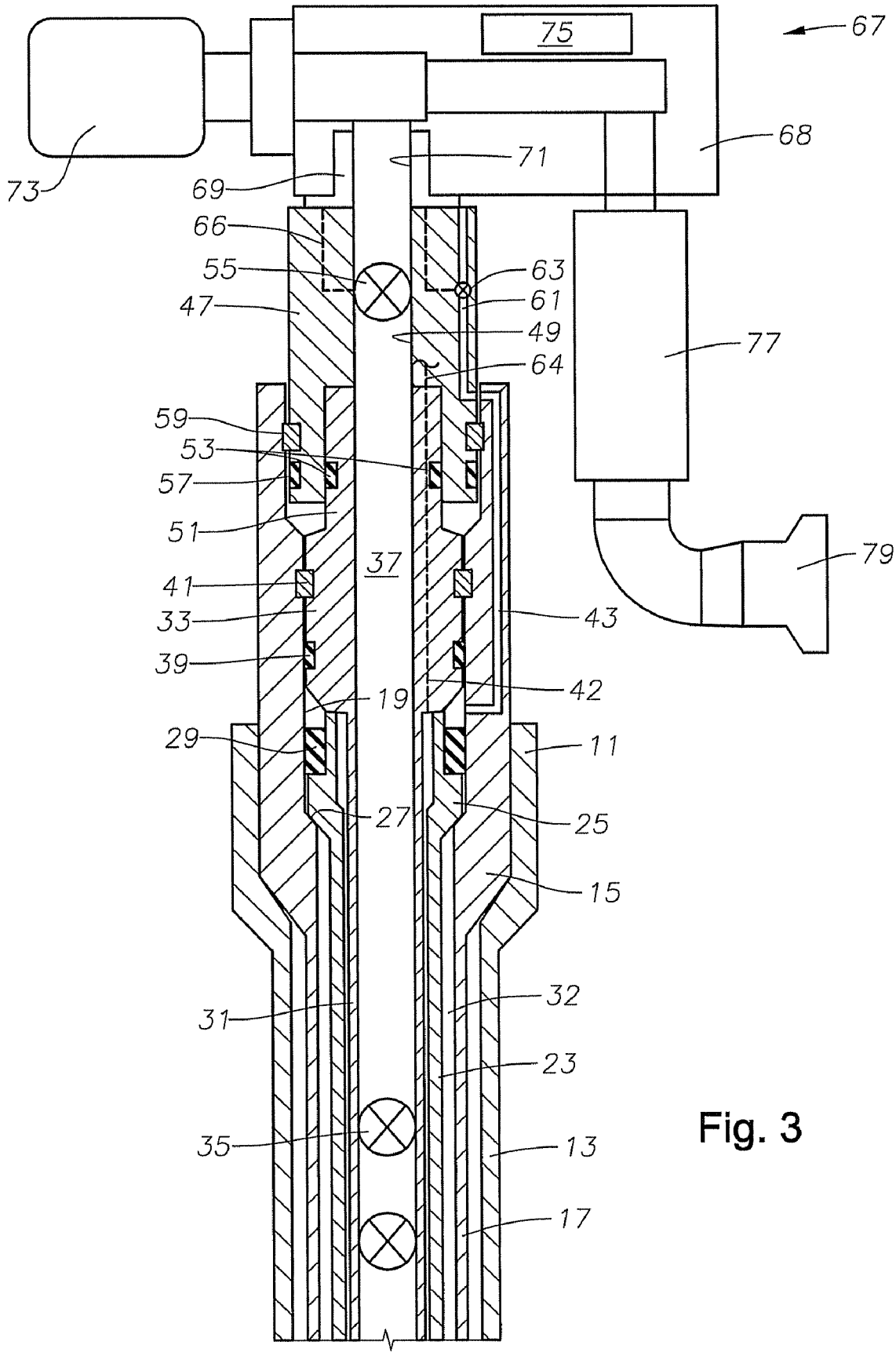
FIG. 3 is a schematic sectional view of the assembly as in FIG. 2, but showing the drilling riser disconnected and a flow line connector assembly installed on the tree block.

From the configuration shown in FIG. 1, the operator will drill the well to a total depth and install one or more strings of casing 23, as shown in FIG. 2. Each string of casing 23 is supported by a casing hanger 25 that lands in inner wellhead housing 15. FIG. 3 illustrates a single casing hanger 25, which is supported on a landing shoulder 27 and sealed to bore 19 by a seal 29.

Next, the operator will run a string of tubing 31 into casing 23. Unlike casing 23, tubing 31 is not cemented in place, and a tubing annulus 32 will exist between casing 23 and tubing 31. Tubing 31 is supported by a tubing hanger 33 that lands within inner wellhead housing 15. In this embodiment, tubing hanger 33 is shown landing on an upper portion of casing hanger 25. A downhole safety valve 35 is mounted in tubing 31. Valve 35 may be conventional and is located a selected depth below tubing hanger 33; for example, 100 to 500 feet. Valve 35 is of a type that will move to a closed position unless supplied with hydraulic fluid under pressure. A hydraulic fluid line (not shown) extends alongside tubing 31 to tubing hanger 33 for providing the supply of hydraulic fluid pressure. Typically, valve 35 is a ball valve. An additional valve 35 may be located in tubing 31 to provide redundancy. When closed, valve 35 will block any flow through well passage 37, which extends axially through tubing hanger 33.

Tubing hanger 33 is sealed to inner wellhead housing bore 19 by a tubing hanger seal 39. Also, a tubing hanger lockdown mechanism 41 will lock tubing hanger 33 to inner wellhead housing 15. Tubing hanger lockdown mechanism 41 may comprise any suitable latching member, but preferably comprises a split ring that is expanded outward by a cam surface on an axially movable piston. Tubing hanger 33 has a number of auxiliary passages 42 (only one shown) extending axially through it. Auxiliary passages 42 are spaced around and parallel to flow passage 37. Some of the auxiliary passages 42 will connect to the hydraulic lines leading to downhole valve 35, while others may have other functions, such supplying fluid pressure to a sliding sleeve valve in tubing 31. Additionally, some of the auxiliary passages 42 may be employed for electrical wire for downhole sensors. Preferably, auxiliary passages 42 extend to the upper end of tubing hanger 33 and have couplings or interfaces at the upper end.

In order to circulate between tubing annulus 32 surrounding tubing 31 and flow passage 37, access must be provided to tubing annulus 32. This could be done with a passage extending axially through tubing hanger 33 offset from flow passage 37. In this example, however, a bypass passage 43 extends within the wall of inner wellhead housing 15 from a point in bore 19 below tubing hanger seal 39 to a point in bore 19 near the upper end of inner wellhead housing 15.

In FIGS. 2 and 3, a tree block 47 is shown in engagement with tubing hanger 33. Tree block 47 is a tubular member having a flow passage 49 extending axially from its lower end to its upper end. Tree block 47 has an outer diameter that is no greater than the maximum inner diameter of inner wellhead housing bore 19, so that it can be lowered through drilling riser 21. Tree block 47 sealingly engages its flow passage 49 with flow passage 37 in tubing hanger 33. The schematic shows tubing hanger 33 as having an upward extending communication or isolation tube 51 having an external seal 53 thereon. Tree block flow passage 49 has a counterbore for sealingly receiving tube 51 Alternatively, communication tube 51 could be mounted to tree block 47 and stab sealingly into a counterbore formed in the upper end of tubing hanger flow passage 37.

Although tree block 47 engages tubing hanger 31, they are not latched or connected to each other in a manner that would allow tree block 47 to support the weight of tubing hanger 33. A valve 55 is located in tree block flow passage 49. Valve 55 is preferably a hydraulically actuated ball valve. Tree block 47 has a seal 57 on its outer diameter that sealingly engages inner wellhead housing bore 19. Tree block 47 also has a latch 59 that when actuated, will engage a recess or profile formed in inner wellhead housing bore 19. Latch 59 may be similar to tubing hanger latch 41.

Tree block 47 may have an annulus passage 61 that is offset and parallel to flow passage 49. The lower end of annulus passage 61 will communicate with the upper end of tubing annulus passage 43. An annulus valve 63 is preferably mounted within tree block 47 and also preferably comprises a hydraulically actuated ball valve. A number of auxiliary passages 64 extend through tree block 47. Passages 64 align and stab into engagement with auxiliary passages 42 in tubing hanger 33. Additionally, a number of auxiliary passages 66 extend from valves 55, 63. The various auxiliary passages 64, 66 extend to connectors on the upper end of tree block 53.

A running string including a running tool 65 is employed to run tree block 47. Running tool 65 may be the same tool as employed for running tubing hanger 33. Running tool 65 is connected to an umbilical (not shown) that leads to the surface for supplying hydraulic fluid pressure to actuate latch 59. Also, preferably, running tool 65 supplies hydraulic fluid pressure to control valves 55, 63.

Referring to FIG. 3, after the well has been perforated and tested, the operator disconnects drilling riser 21 (FIG. 2) and lowers a flow line connection module 67 from the sea. Flow line connection module 67 has a housing 68 with a connector 69 on its lower end for latching into tree block 47. Connector 69 has a locking member to-latch module 67 to tree block 47, which supports the weight of module 67. A tube (not shown), which may be either mounted to the upper end of tree block 47 or to the lower end of module 67, sealingly connects tree block flow passage 49 with a flow passage 71 in module 67. Additionally, connector 69 will include interface couplings for connecting to the various auxiliary lines for controlling lower valve 35, upper valve 55 and tubing annulus valve 63.

Module 67 includes a conventional choke 73 that is adjusted incrementally to vary a cross-sectional flow area of an orifice for maintaining a desired back-pressure within tree block flow passage 49. Module 67 has a set of controls 75 that control the various functions, including choke 73 and valves 35, 55 and 63. Controls 75 may include hydraulic pilot valves and electrical components. Module 67 may also have a flow meter 77 mounted to it for measuring the flow rate through flow passage 71. Flow meter 77 may be a multi-phase type for measuring a flow rate of a mixture of oil and gas. A flow line coupling 79 is shown attached to flow meter 77 for connecting module 67 to a flow line.

In operation, after the well is drilled and cased with casing 23, the operator installs tubing 31 and tubing hanger 33. This is preferably done with a conventional running tool that actuates latch 41. Tubing hanger 33 will be run through drilling riser 21 in a conventional manner and does not require orientation.

In the preferred embodiment, the operator then retrieves the running tool and lowers tree block 47 through drilling riser 21 on a running tool 65. As tree block 47 approaches tubing hanger 33, it will be oriented so that the auxiliary passages 64 align and stab into sealing engagement with auxiliary passages 42. An orientation device, such as a mule shoe may be located on the upper portion of tubing hanger 33 to accomplish orientation. The lower portion of tree block 47 extends into inner wellhead housing 15, and the operator employs running tool 65 to actuate latch 59 to latch tree block 47 to inner wellhead housing bore 19.

Preferably, while running tool 65 is still connected, and the operator is in control through the umbilical, he will complete and test the well. This would involve opening lower valve 35 and upper valve 55, then running a perforating gun through tubing 31 to perforate casing 23. The completion operation will also involve circulating between tubing 31 and tubing annulus 32 by opening tubing annulus valve 63 to enable circulation back through the interior of riser 21 surrounding the running string and running tool 65. The operator will also test the well by flowing well fluids up tubing 31 and up the running string.

After the well has been completed and tested, the operator closes valves 35, 55 and 63 through controls associated with running tool 65. The operator disconnects running tool 65 and retrieves the running string. The operator disconnects drilling riser 21 from inner wellhead housing 15. The well production passages 37, 49 will have two safety barriers, these being downhole safety valve 35 and tree block valve 55. The operator then lowers module 67 and orients module 67 relative to tree block 47. Once connector 69 is connected, controls 75 will provide control at the platform of the various functions, including control of downhole valve 35, tree block valve 55, and tubing annulus valve 63. The operator opens valves 35 and 55 to allow production flow through module flow passage 71 and out through coupling 79 to a flow line. Downhole valve 35 serves as a master valve, and tree block 55 serves as a wing valve for the production flow.

The invention has significant advantages. The tree block is simpler than prior trees in that it has fewer valves. The valves, being ball valves, are more compact than gate valves typically employed with downhole trees. Using the downhole safety valve as a master valve avoids the need for a second master valve. Being able to run the tree block through the drilling riser provides a safe and efficient manner to complete the well.

While the invention has been shown in only one of its forms, it should be apparent to those skilled in the art that it is not so limited but is susceptible to various changes without departing from the scope of the invention. For example, the operator could perforate and complete the well before running the tree block. In that instance, the operator could install a temporary wire line plug in the flow passage of the tubing hanger until the tree block is installed. The wire line plug would be retrieved with the running string for the tree block before disconnecting the drilling riser. Also, rather than use the downhole safety valve as a master valve, a valve could be mounted to the tubing hanger.

We claim:

1. A method of completing a subsea well having a subsea wellhead housing and at least one string of casing supported by a casing hanger in the wellhead housing, comprising:

(a) connecting a riser to the subsea wellhead housing;

(b) providing an tree block with a flow passage containing an upper valve, and providing a tubing assembly comprising a string of tubing and a tubing hanger, each of the tubing and the tubing hanger having a flow passage, at least one of which contains a lower valve;

(c) lowering the tubing assembly through the riser and latching and sealing the tubing hanger to the wellhead housing;

(d) lowering the tree block through the riser and latching and sealing the tree block to the wellhead housing with the flow passage in the tree block in communication with the flow passage in the tubing hanger; then (e) disconnecting the riser from the wellhead housing; then (f) connecting a flowline connection module to the tree block, the module having a flow passage that registers with the flow passage in the tree block; and (g) connecting the flow passage of the flowline connection module to a flowline, opening the upper and lower valves and flowing fluid through the flow passage in the module and the flowline.

2. The method according to claim 1, wherein step (d) comprises inserting a lower portion of the tree block into the wellhead housing and sealing the lower portion of the tree block to the wellhead housing.

3. The method according to claim 2, further comprising causing an upper portion of the tree block to protrude above the wellhead housing, and step (f) comprises supporting the module on the tree block

4. The method according to claim 1, wherein step (d) occurs after the completion of step (c).

5. The method according to claim 1, wherein:

step (c) comprises lowering the tubing assembly on a running string; and the method further comprises:

after step (c) and before step (e), perforating the casing and causing well fluid to flow up the tubing and the running string to test the well.

6. The method according to claim 1, wherein:

step (d) comprises lowering the tree block on a running string; and the method further comprises:

after steps (c) and (d) and before step (e), perforating the casing and causing well fluid to flow up the tubing and the running string to test the well.

7. The method according to claim 1, wherein:

step (c) comprises lowering the tubing hanger on a running string; and the method further comprises:

after step (c) and before step (d), perforating the casing and opening the lower valve to cause well fluid to flow up the tubing and the running string to test the well; then installing a wire line plug in the flow passage in the tubing hanger.

8. The method according to claim 1, further comprising providing the module of step (f) with a choke, and step (g) comprises metering the flow through the flow passage of the module with the choke.

9. The method according to claim 1, wherein step (f) further comprises providing the flow connection module with a valve control system, and step (g) comprises opening the lower valve and the upper valve with the valve control system.

10. A method of completing a subsea well having a subsea wellhead housing with a bore, at least one string of casing supported by a casing hanger in the bore of the wellhead housing, and a riser connected to the exterior of the subsea wellhead housing, the method comprising:

(a) lowering a string of tubing and a tubing hanger through the riser and landing and sealing the tubing hanger in the bore of the wellhead housing, the tubing and the tubing hanger each having a flow passage, at least one of which contains a lower valve, (b) lowering the tree block through the riser and latching and sealing the tree block to the bore of the wellhead housing such that the tree block protrudes above the wellhead housing, the tree block having a flow passage that registers with the flow passage in the tubing hanger and contains an upper valve;

(c) disconnecting the riser from the wellhead housing;

(d) providing a flowline connection module with a flow passage, a choke, and a valve control system, and after step (c) landing the module on and connecting the module to the tree block; and (e) connecting the flow passage of the module to a flowline, and with the valve control system, opening the upper and lower valves and flowing fluid through the flow passage of the module and the flowline.

11. The method according to claim 10, further comprising: after step (b) and before step (c), perforating and testing the well.

12. The method according to claim 10, further comprising:

after step (a) and before step (b), perforating the casing and installing a wire line plug within the flow passage of the tubing hanger; and the method further comprises:

retrieving the wire line plug after step (b) and before step (c).

13. The method according to claim 10, wherein step (a) comprises providing a ball valve as the upper valve.

14. The method according to claim 10, step (b) occurs after step (a) has been completed.

* * * * *